US008624886B2

(12) United States Patent
Uehara

(10) Patent No.: US 8,624,886 B2
(45) Date of Patent: Jan. 7, 2014

(54) LIGHT EMISSION DRIVING DEVICE, ILLUMINATION DEVICE, DISPLAY DEVICE

(75) Inventor: Hidenori Uehara, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 402 days.

(21) Appl. No.: 13/028,293

(22) Filed: Feb. 16, 2011

(65) Prior Publication Data

US 2011/0204795 A1 Aug. 25, 2011

(30) Foreign Application Priority Data

Feb. 22, 2010 (JP) ..... 2010-035631

(51) Int. Cl.
*G09G 5/00* (2006.01)

(52) U.S. Cl.
USPC ..... 345/207; 345/691; 345/102

(58) Field of Classification Search
USPC ..... 345/204, 207, 690, 691, 102; 315/149, 315/152–154, 312, 320, 323, 324, 360
See application file for complete search history.

(56) References Cited

U.S. PATENT DOCUMENTS

| | | | | |
|---|---|---|---|---|
| 7,952,555 | B2 * | 5/2011 | Sakai | 345/102 |
| 8,067,894 | B2 * | 11/2011 | Katsu | 315/158 |
| 2006/0097978 | A1 * | 5/2006 | Ng et al. | 345/102 |
| 2008/0012820 | A1 * | 1/2008 | Yang et al. | 345/102 |
| 2009/0167674 | A1 * | 7/2009 | Katsu | 345/102 |
| 2010/0085338 | A1 * | 4/2010 | Miguchi | 345/207 |

FOREIGN PATENT DOCUMENTS

| | | |
|---|---|---|
| JP | 11-295689 | 10/1999 |
| JP | 2001-235729 | 8/2001 |

* cited by examiner

*Primary Examiner* — Thuy Vinh Tran
(74) *Attorney, Agent, or Firm* — Fish & Richardson P.C.

(57) ABSTRACT

A light emission driving device sequentially on a time division basis drives a red light source (200R), a green light source (200G), and a blue light source (200B), to calculate a light emission amount control parameter (PWM(k+1)) for setting the light emission amount for one of the light sources. The following values are used: a detected light emission amount (DET(k)) detected for a previous illumination of the same light source, a predetermined value (REF(k+1)) for comparison to the detected light emission amount (DET(k)), and the light emission amount control parameters (PWM(k)) for a previous illumination of the same light source.

19 Claims, 8 Drawing Sheets

LIGHT EMISSION DRIVING DEVICE, ILLUMINATION DEVICE, DISPLAY DEVICE

TECHNICAL FIELD

This disclosure relates to a light emission driving device to drive multiple light sources sequentially on a time division basis, and an illumination device and a display device using the same.

BACKGROUND

A technique is known to illuminate a combined white color light to improve color reproduction for a liquid crystal display by utilizing multiple light sources, which illuminate different colors (red (R), green (G), blue (B) and so on) as a backlight source. An example of this technique is disclosed in Japanese patent publication No. H11-295689.

FIG. 8 is a block diagram of a display device in accordance with the related art. The configuration is the same as the one disclosed by Japanese patent publication No. JPH11-295689. In this conventional display device, a feedback control technique is adopted to maintain the value of a light emission amount equal to a predetermined value by detecting the light emission amount from multiple light sources, so as to maintain the white balance set at the time of shipment or user setting, regardless of temperature variation or other time dependent variation.

A known technique to illuminate a liquid crystal element includes driving multiple light sources, which illuminate different colors (red (R), green (G), blue (B) and so on), sequentially on a time division basis. An example of this technique is disclosed in Japanese patent publication No. 2001-235729.

The technique disclosed in Japanese patent publication No. H11-295689 is able to provide a liquid crystal display device with fine color reproduction regardless of variations in environmental temperature.

White color is generated by illuminating multiple different color light sources simultaneously in Japanese patent publication No. H11-295689. Accordingly, multiple photo detectors are required to detect a light emission amount corresponding, respectively, to each color of the light sources. Furthermore, multiple operation circuits for feedback control are required corresponding to each of the light sources. This results in an increase of device size or cost.

In addition, a technique to generate white light by driving multiple light sources sequentially is disclosed in Japanese publication No. JP2001-235729. In particular, a technique is disclosed to control an illumination period corresponding to a variation of ambient temperature, against a delaying caused in a low temperature circumstance. However, there is no disclosure about a technique to adjust a white balance in view of a temperature variation or a time dependent variation of the light sources themselves.

SUMMARY

The details of one or more implementations of the invention are set forth in the accompanying drawings and the description below. Other features and advantages will be apparent from the description and drawings, and from the claims.

In some implementations, the disclosure provides a light emission driving device to drive multiple light sources sequentially on a time division basis, and an illumination device and a display device using the driving device which can maintain a fine color reproduction regardless of a temperature variation or a time dependent variation, without increasing the device scale or cost.

According to one aspect, a light emission driving device to drive multiple light sources sequentially on a time division basis calculates an light emission amount control parameter to control a light emission amount for one of the light sources. The parameter is calculated based on a detected light emission amount for a previous illumination of the same light source, a predetermined value for comparison to the detected light emission amount, and the light emission amount control parameter set for a previous illumination of the same light source.

In some implementations, the light emission driving device includes a first storing part to store a detected light emission amount at a moment of a previous illumination for one of the light sources, and a second storing part to store a predetermined value for comparison to the detected light emission amount, a third storing part to store an light emission amount control parameter set for the previous illumination of the same light source, and an operation circuit to calculate an output to control the same light source according to outputs from foregoing three storing parts.

DETAILED DESCRIPTION

Figure 1:
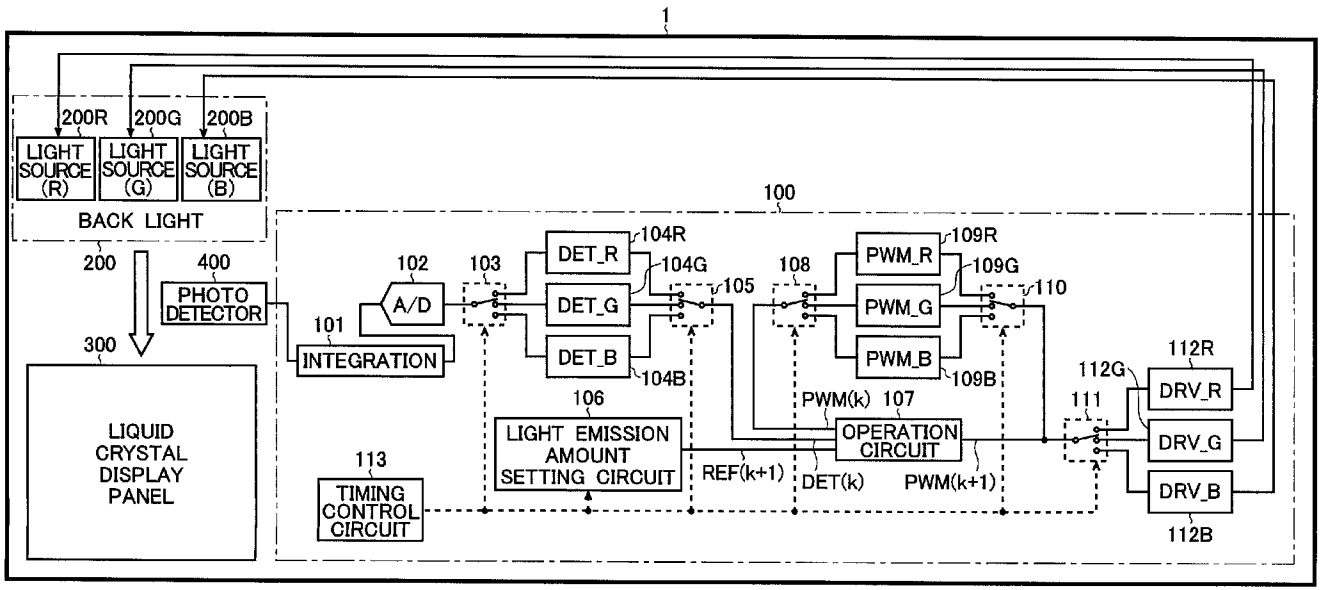
FIG. 1 is a block diagram of a display device in accordance with an embodiment of the invention.

As illustrated in FIG. 1, a display device 1 includes a light emission driving device 100, a backlight 200, a liquid crystal display panel 300, and a photo detector 400.

The light emission driving device 100 can be implemented as a semiconductor device (a backlight driver IC) to drive multiple light sources sequentially on a time division basis by receiving an electrical signal from the photo detector 400, wherein the backlight 200 includes the light sources. Internal construction of the light emission driving device 100 is described in detail below.

The backlight 200 is an illumination device to illuminate the liquid crystal display panel 300 from behind, and includes multiple light sources which emit different colors from one another. (In the illustrated embodiment, the light sources include a red light source 200R, a green light source 200G, a blue light source 200B). These three light sources 200R, 200G, and 200B are driven sequentially on a time division basis according to the control signals from the light emission driving device 100, and, in combination, provide white light. In this embodiment, light emitting diodes are used as the three light sources 200R, 200G, and 200B.

As an illumination output control parameter to determine a light emission amount (e.g., an illumination power), either a current value of the driving current which flows through each of the light sources or a control value for performing PWM (e.g., a value which sets a duty ratio for the period of PWM) is used.

In the following description, for simplicity of explanation, a current value of the driving current which flows through each of the light sources is fixed as a constant value. Variable control is described only for a control value for performing PWM.

The liquid crystal display panel 300 is an image output device which provides a light transmission of the liquid crystal as a picture element. The light transmission changes according to the input image signal.

The photo detector 400 can be implemented as a sole photoelectric converting device that convert light signals emitted sequentially on a time division basis from the light sources 200R, 200G, and 200B, to corresponding electrical signals. A photo diode or a photo transistor can be used as the photo detector 400. It is desirable for the photo detector 400 to detect each of the emitted light colors equally (i.e., not to have a directional characteristic biased to specific colors of red, green or blue light).

In the display device 1 according to the illustrated example, the light emission driving device 100 includes an integration circuit 101, an analog-to-digital conversion circuit 102, a selector 103, a first register 104 (a register 104R for red color light emission amount, a register 104G for green color light emission amount, a register 104B for blue color light emission amount), a selector 105, a light emission amount setting circuit 106, an operation circuit 107, a selector 108, a second register 109 (including a red color PWM value register 109R, a green color PWM value register 109G, a blue color PWM value register 109B), a selector 110, a selector 111, a driver 112 (including a red color driver 112R, a green color driver 112G, a blue color driver 112B), and a timing control circuit 113.

The integration circuit 101 generates an analog signal by integrating an electrical signal obtained from the photo detector 400.

The analog-to-digital conversion circuit 102 converts an analog signal obtained from the integration circuit 101 to a digital signal, and provides a digital signal to the first register 104 via the selector 103.

The selector 103 sequentially on a time division basis connects an output terminal of the analog-to-digital conversion circuit 102 with input terminals of the register 104R for red color light emission amount or the register 104G for green color light emission amount or the register 104B for blue color light emission amount, in accordance with a switching control signal from the timing control circuit 113.

The first register 104 includes the register 104R for red color light emission amount, the register 104G for green color light emission amount, and the register 104B for blue color light emission amount.

The register 104R for red color light emission amount temporarily stores a value DET_R(k) corresponding to a signal detected by the photo detector 400 during illumination of the red light source 200R at frame k.

The register 104G for green color light emission amount temporarily stores a value DET_G(k) corresponding to a signal detected by the photo detector 400 during illumination of the green light source 200G at frame k.

The register 104B for blue color light emission amount temporarily stores a value DET_B(k) corresponding to a signal detected by the photo detector 400 during illumination of the blue light source 200B at frame k.

The selector 105 sequentially on a time division basis connects the first input terminal of the operation circuit 107 with output terminals of the register 104R for red color light emission amount or the register 104G for green color light emission amount or the register 104B for blue color light emission amount, in accordance with the switching control signal from the timing control circuit 113.

The light emission amount setting circuit 106 provides predetermined values REF_R(k+1), REF_G(k+1), and REF_B(k+1) to determine the light emission amount for each of the light sources at frame k+1. The predetermined values are provided to a second input terminal of the operation circuit 107.

The light emission amount setting circuit 106 stores a non-volatile target value detected previously in a circumstance of a white balance is balanced (e.g., at the time of shipment or based on a user setting), as the predetermined values REF_R(k+1), REF_G(k+1), and REF_B(k+1).

If a brightness control is required for the backlight 200, a target value of the light emission amount is stored for each of the brightness levels.

The operation circuit 107 calculates light emission amount control parameters PWM(k+1) for each of the light sources to be set at frame k+1, based on an output from the first register 104 (i.e., a detected light emission amount DET(k) at frame k), based on an output from the light emission amount setting circuit 106 (REF_(k+1) for determining the light emission amount for each of the light sources at frame (k+1)), and based on an output from the second register 109 (i.e., light emission amount control parameters PWM (k) for each of the light sources set at frame k).

The detailed internal construction for the operation circuit 107 is described below.

The selector 108 sequentially on a time division basis connects a third input terminal of the operation circuit 107 with output terminals of the red color PWM register 109R or the green color PWM register 109G or the blue color PWM register 109B, in accordance with the switching control signal from the timing control circuit 113.

The second register 109 includes the red color PWM register 109R, the green color PWM register 109G, and the blue color PWM register 109B.

The red color PWM register 109R temporarily stores an light emission amount control parameter PWM_R(k) set during illumination of the red light source 200R at frame k.

The green color PWM register 109G temporarily stores an light emission amount control parameter PWM_G(k) set during illumination of the green light source 200G at frame k.

The blue color PWM register 109B temporarily stores an light emission amount control parameter PWM_B(k) set during illumination of the blue light source 200B at frame k.

The selector 110 sequentially on a time division basis connects an output terminal of the operation circuit 107 with input terminals of the red color PWM register 109R or the green color PWM register 109G or the blue color PWM register 109B, according to the switching control signal from the timing control circuit 113.

The selector 111 sequentially on a time division basis connects an output terminal of the operation circuit 107 with input terminals of the red LED driver 112R or the green LED driver 112G or the blue LED driver 112B, according to the switching control signal from the timing control circuit 113.

The driver 112 includes the red LED driver 112R, the green LED driver 112G, and blue LED driver 112B. The driver 112 sequentially on a time division basis drives the red light source 200R, the green light source 200G, and the blue light source 200B, according to the light emission amount control parameters PWM(k+1) for each of the light sources calculated by the operation circuit 107.

The timing control circuit 113 generates timing control signals to synchronize the signal path switching control for each of the selector 103, the selector 105, the selector 108, the selector 110, and the selector 111, with the output control of the light emission amount setting circuit 106.

Figure 2:
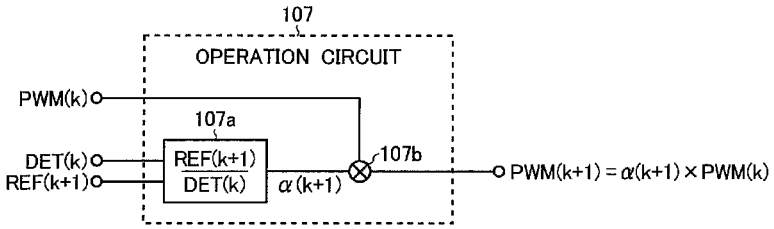
FIG. 2 is a block diagram showing an example of an operation circuit.

As illustrated in FIG. 2, an example of the operation circuit 107 includes a calculation part 107*a* for calculating a correction coefficient, and a multiplication part 107*b*.

The calculation part 107*a* for calculating a correction coefficient calculates a correction coefficient value α (k+1) by dividing an output from the light emission amount setting circuit 106 (a predetermined value REF(k+1) to determine an light emission amount at frame k+1) by an output from the first register 104 (a detected light emission amount DET (k) at frame k).

If the detected light emission amount DET(k) is larger than the predetermined value REF(k+1), a correction coefficient value α (k+1) is smaller than 1. If the detected light emission amount DET(k) is smaller than the predetermined value REF (k+1), the correction coefficient value α (k+1) is larger than 1.

The multiplication part 107*b* calculates the light emission amount control parameters PWM(k+1) set for each of the light sources at frame (k+1) by multiplying an output from the second register 109 (the light emission amount control parameters PWM(k) set during illumination of the light sources at frame k) by the correction efficiency value α (k+1)

Figure 3:
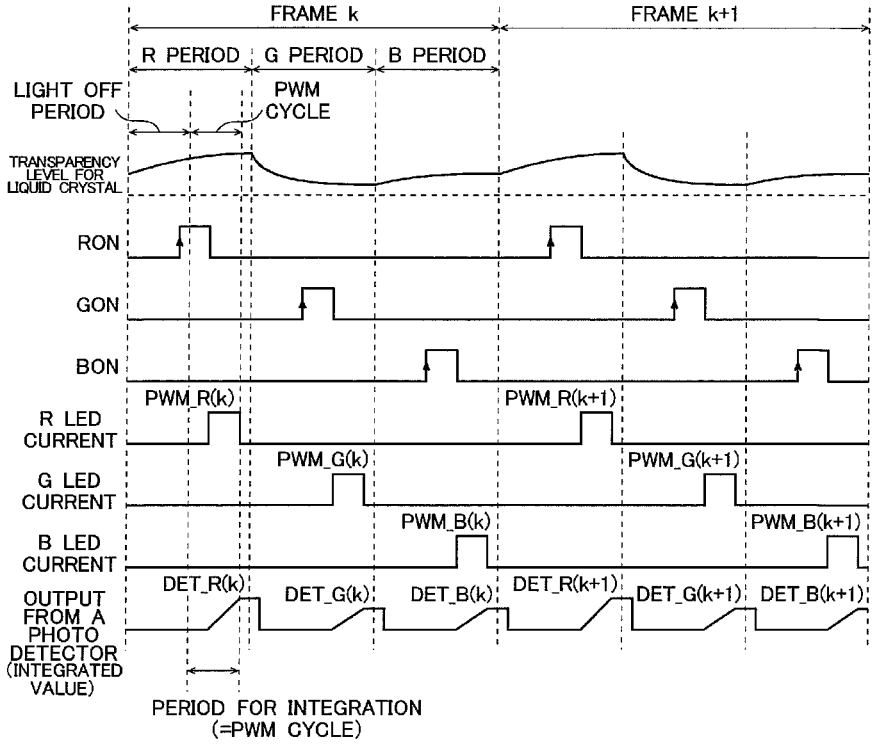
FIG. 3 is a timing chart diagram showing a first operation example of a light emission driving device.

FIG. 3 is a timing chart diagram for a first operation example of the light emission driving device 100. Starting from the top of the diagram, FIG. 3 shows, respectively, a transparency level for a liquid crystal, an on signal RON for red color, an on signal GON for green color, an on signal BON for blue color, a driving current for red light source 200R, a driving current for green light source 200G, a driving current for blue light source 200B, and an output from a photo detector (integrated value).

In reference to the first operation example of FIG. 3, the liquid crystal display panel 300 is driven by a field sequential driving method. One frame period is divided equally into three portions of period R for a red picture image, period G for a green picture image, and period B for a blue picture image.

In the following description, control of an light emission amount for the red light source 200R is described. However, the same control technique also can be applied for both of the green source 200G and the blue source 200B.

When an ON signal RON for red light becomes high during a period R at frame k, the timing control circuit 113 calculates the light emission amount control parameters PWM_R(k) for the red light source 200R set at frame k, in advance of illumination of the red light source 200R.

At the same time, the following outputs are provided to the operation circuit 107: an output from the first register 104 (i.e., a detected light emission amount DET_R(k−1) for the red light source 200R at frame k−1), an output from the light emission amount setting circuit 106 (i.e., a predetermined value REF_R(k) to determine the light emission amount for the red light source at frame k), an output from the second register 109 (i.e., an light emission amount control parameter PWM(k−1) for the red light source 200R set at frame k−1).

When a power source is being activated, both predetermined default values DET_R(0) and PWM_R(0) are supplied respectively to the first register 104 and the second register 109. This construction enables the operation circuit 107 to calculate an light emission amount control parameter PWM_R(1) at frame 1.

A detailed description for the operation circuit 107 was described above and, therefore, is not repeated here.

Once the light emission amount control parameter PWM_R(k) is calculated, the red LED driver 112R drives red light source 200R with a predetermined ON duty. While the red light source 200R is being driven, the photo detector 400 provides a current signal in accordance with the light emission amount from the red light source 200R. Then an output voltage of the integration circuit 101 continues to rise.

An integration period for detecting an output from the photo detector 400 is set either as the aforementioned period R or as the cycle period of PWM for the red light source 200R.

Subsequently, an output voltage value from the integration circuit 101, when the red light source 200R is turned off, is temporarily stored in the register 104R for red color light emission amount as the light emission amount DET_R(k) for the red light source 200R at frame k.

Thus, sequential operations to detect the light emission amount DET_R(k) for the red light source 200R and to store the DET_R(k) in the register 104R for the red color light emission amount, are accomplished by the beginning of the illumination of the green light source 200G.

Furthermore, the previously calculated light emission amount control parameter PWM_R(k) is temporarily stored in the red color PWM register 109R.

Illumination cycle for the red light source 200R is accomplished by foregoing sequential flow. Then the green light source 200G and the blue light source 200B are selected sequentially on a time division basis.

The same control method described above is repeated.

When an ON signal RON for red light becomes high during a period R at frame k+1, the timing control circuit 113 calculates the light emission amount control parameter PWM_R (k+1) for the red light source 200R set at frame k+1, in advance of illumination of the red light source 200R.

At the same time, the following are provided to the operation circuit 107: an output from the first register 104 (i.e., a detected light emission amount DET_R(k) for the red light source 200B at frame k), an output from the light emission amount setting circuit 106 (i.e., a predetermined value REF_R(k+1) to determine the light emission amount for red light source at frame k+1), and an output from the second register 109 (i.e., the light emission amount control parameters PWM(k) for red light source 200R set at frame k).

Figure 4:
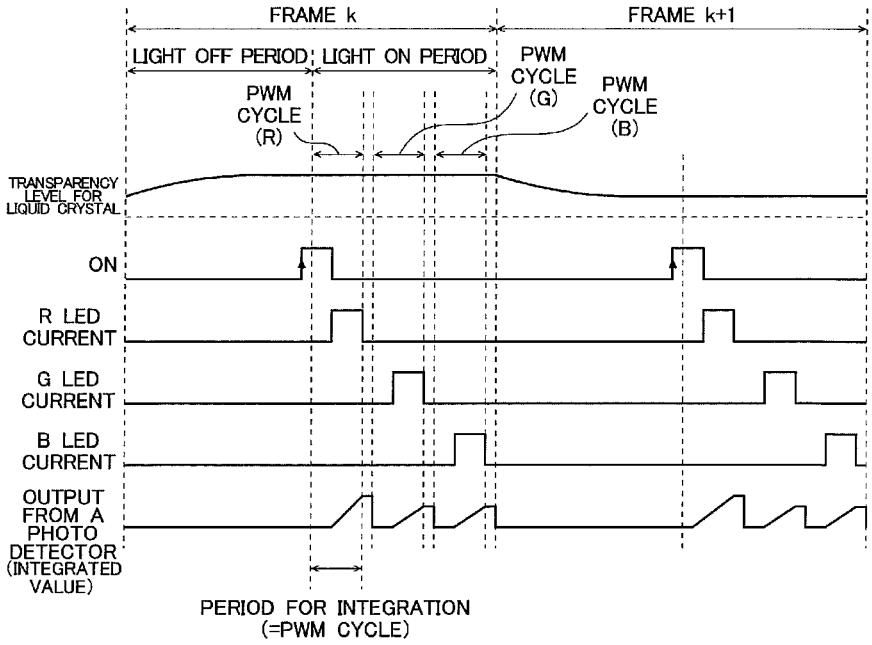
FIG. 4 is a timing chart diagram showing a second operation example of the light emission driving device.

FIG. 4 is a timing chart diagram showing a second operation example for the light emission driving device 100. Starting from the top of the drawing, the following signals are illustrated: a transparency level for a liquid crystal, a backlight ON signal, a driving current for the red light source 200R, a driving current for the green light source 200G, a driving current for the blue light source 200B, and an output from a photo detector (integrated value).

The second example of FIG. 4 is different from the first example because the liquid crystal display panel 300 is not driven by the field sequential driving technique.

The red light source 200R, the green light source 200G, and the blue light source 200B are sequentially on a time division basis driven in accordance with ON timing of the backlight ON signal. The sequential driving operation occurs during an illumination period in one frame period.

Thus, the backlight 200 is driven by a pseudo impulse driving method that includes at least one light OFF period in one frame period. This construction enables enhancement of the display performance by resolving an retina alternating effect for humans.

Figure 5:
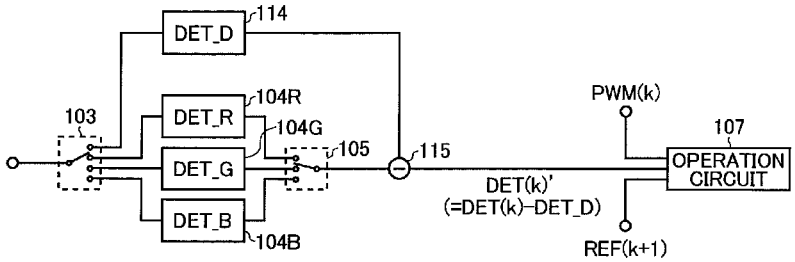
FIG. 5 is a block diagram showing another example of the light emission driving device.

FIG. 5 is a block diagram showing another example of the light emission driving device 100. The light emission driving device 100 according to this example includes a third register 114 to temporarily store a dark current value DET_D sensed by the photo detector 400 with all light sources in the OFF state, a subtraction part 115 to calculate a corrected light emission amount DET(k)' by subtracting the dark current value DET_D from the detected light emission amount DET (k) temporarily stored in the first register 104.

The operation circuit 107 substitutes an output DET(k)' from the subtraction part 115 with the detected light emission amount DET(k) from the first register 104 while calculating the light emission amount control parameters PWM(k+1) for respective light sources. More precise control of a white balance for the backlight 200 without any effect of dark current that occurred at photo detector 400 can be achieved with this implementation.

Figure 6:
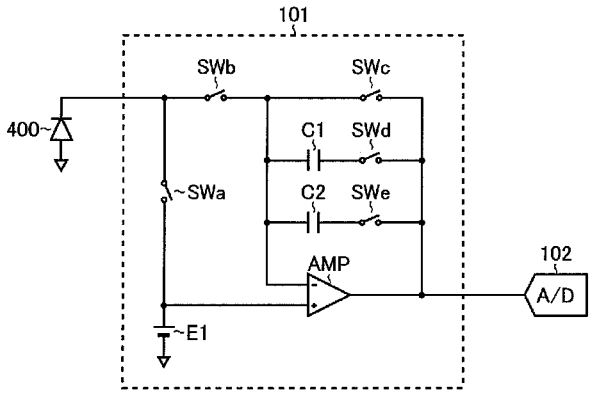
FIG. 6 is a circuit diagram showing an example of an integration circuit.

FIG. 6 is a circuit diagram showing an example of the integration circuit 101. In this embodiment, the integration circuit 101 includes an operational amplifier AMP, capacitors C1 and C2, and switches SWa to SWe, and a DC power supply source E1.

A non-inverting input terminal (+) of the operational amplifier AMP is connected to an anode terminal of the DC power supply source E1 and a first terminal of the switch SWa. A cathode terminal of the DC power supply E1 is connected to a predetermined voltage level. An inverting terminal (−) of the amplifier AMP is connected to a first terminal of the capacitor C1, to a first terminal of the capacitor C2, to a first terminal of the switch SWc, and to a first terminal of the switch SWb. A second terminal of the switch SWa and a second terminal of the switch SWb are connected to a cathode terminal of a photo diode forming the photo detector 400. An anode terminal of the photo diode is connected to the predetermined voltage level. A second terminal of the capacitor C1 and a second terminal of the capacitor C2 are respectively connected to a first terminal of the switch SWd and a first terminal of the switch SWe. Each second terminal of the switches SWc to SWe is respectively connected to an output terminal of the operational amplifier AMP. An output terminal of the operational amplifier AMP forms an output terminal of the integration circuit 101, and the output terminal is connected to an input terminal of the analog-to-digital conversion circuit 102.

Figure 7:
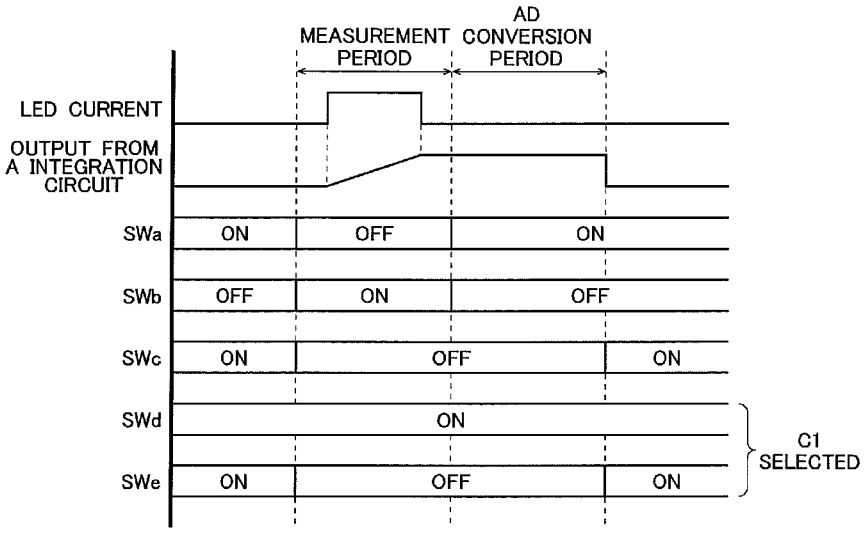
FIG. 7 is a timing chart diagram showing a variable output gain operation of the integration circuit.
Figure 8:
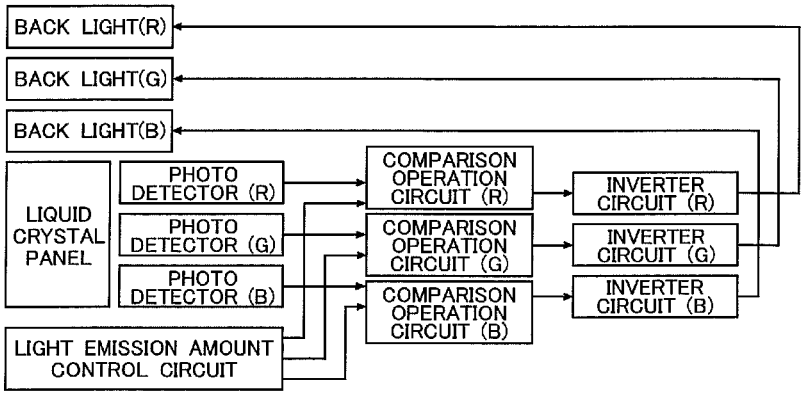
FIG. 8 Related Art
FIG. 8 is block diagram of a display device in accordance with the related art.

FIG. 7 is a timing chart diagram showing a variable output gain operation of the integration circuit 101. Starting at the top of the diagram, the following signals are shown: a LED current (i.e., driving current for light sources), an output from the integration circuit 107, and ON-OFF states of the switches SWa to SWe. FIG. 7. shows the state when the capacitor C1 is selected.

By the time the measurement period of the LED current is started, the switch SWa and the switches SWc to SWe are in an ON state, and the switch SWb is in an OFF state. Thus, electric charge of the photo diode forming the photo detector 400 is discharged, the electric charges of the capacitor C1 and the capacitor C2 are discharged, and an output from the integration circuit 101 is reset to zero.

During the measurement period of the LED current, the switch SWa, the switch SWc, and the switch SWe change to the OFF state, and the switch SWb and the switch SWd change to the ON state. Thus, only the capacitor C1 is connected to the negative feedback loop of the amplifier AMP.

During the analog-to-digital conversion period, the switch SWa and the switch SWd change to the ON state, and the switches SWb, SWc and SWe change to the OFF state. Thus, a current path to the capacitor C1 is in a cut-off state and keeps electric charge. Electric charge from the photo diode forming the photo detector 400 is discharged thorough the switch SWa.

FIG. 7 shows the states when the capacitor C1 is selected. If the capacitor C2 is selected, the switch SWe changes to the ON state (instead of the switch SWd) during the measurement period of the LED current and during the analog-to-digital conversion period.

If the capacitor C1 and the capacitor C2 are selected, both switches SWd and SWe change to the ON state during the measurement period of the LED current and during the analog-to-digital conversion period.

Thus, the output gain can be changed for each of the light sources. This construction enables the dynamic range of the analog signal provided to the analog-to-digital conversion circuit 102 to stay within a constant range, regardless of a fluctuation between the current amount detected by the photo detector 400 for each of the light sources.

As described above, the light emission driving device 100 in this embodiment drives multiple sources 200R, 200G, and 200B sequentially on a time division basis. To calculate the light emission amount control parameters PWM(k+1) for setting the light emission amount for one of the light sources, the following signals are provided: a detected light emission amount DET(k) detected for a previous illumination of the same light source, a predetermined value REF(k+1) for comparison to the detected light emission amount DET(k), the light emission amount control parameters PWM(k) for a previous illumination of the same light source.

The light sources 200R, 200G and 200B are not simultaneously illuminated by adopting this construction. Thus, multiple photo detectors to detect light emission amounts corresponding to each color of the light sources are not required. Only one illumination sensor for the photo detector 400 is needed. Accordingly, a fine color reproduction can be realized regardless of the temperature variation or time dependent variation of the light sources, without increasing size or cost.

Additionally, the light sources are not illuminated continuously all the time, and the disclosure can enable use of a field sequential method to drive the liquid crystal display panel 300. Also, the disclosure facilitates using a pseudo impulse driving method to drive the backlight 200.

The light emission driving device 100 according to some embodiments adopts a method to detect the light emission amount according to each illumination period for the light sources, and a response speed for controlling the brightness of the backlight 200 is enhanced. Accordingly, local brightness control for the backlight 200 can enhance the contrast of the liquid crystal display panel 300.

In some of the foregoing embodiments, a light emission driving device to drive a backlight for a liquid crystal display is described. The configurations are not limited to the particular illustrated examples. Thus, a large variety of light sources (e.g. organic electroluminescence elemental device) can be used.

A number of implementations of the invention have been described. Nevertheless, various modifications can be made without departing from the spirit and scope of the invention. Accordingly, other implementations are within the scope of the claims.

What is claimed is:

1. A light emission driving device to drive multiple light sources sequentially on a time division basis comprising:

a control circuit arranged to calculate a light emission amount control parameter to control a light emission amount for one of the light sources based on a detected light emission amount for a previous illumination of the same light source, a predetermined value for comparison to the detected light emission amount, and a light emission amount control parameter set for the previous illumination of the same light source, wherein the control circuit includes:

a first register to store detected light emission amounts for respective previous illuminations of the light sources detected sequentially on a time division basis by a photo detector;

a light emission amount setting circuit to provide predetermined values for each of the light sources;

a second register to store light emission amount control parameters for respective previous illuminations of the light sources;

an operation circuit to calculate light emission amount control parameters for each of the light sources based on an output from the first register, an output from the light emission amount setting circuit, and an output from the second register; and driving circuits to drive the light sources sequentially on a time division basis based on light emission amount control parameters for each of light sources calculated by the operation circuit.

2. The light emission driving device according to claim 1, wherein detection of a light emission amount for one of the light sources is accomplished by the beginning of an illumination for one of the other light sources.

3. The light emission driving device according to claim 1, wherein the light emission amount control parameter is either a current value of a driving current which flows through said one of the light sources or a control value for performing PWM.

4. The light emission driving device according to claim 1, wherein the operation circuit comprises:

a calculation part for calculating a correction coefficient to calculate a correction coefficient value by dividing the predetermined value by the detected light emission amount; and a multiplication part to calculate a subsequent light emission amount control parameter by multiplying a light emission amount control parameter set for a previous illumination by the correction coefficient value.

5. The light emission driving device according to claim 1 wherein the control circuit further includes:

a third register to store a dark current value detected by the photo detector when all of the light sources are in an OFF state; and a subtraction part to subtract the dark current value from the detected light emission amount;

wherein the operation circuit is arranged to substitute an output from the subtraction part with an output from the first register while calculating the light emission amount control parameters for respective light sources.

6. The light emission driving device according to claim 1 wherein the control circuit further includes:

an integration circuit to generate an analog signal by integrating an electrical signal from the photo detector; and analog-to-digital conversion circuit to provide a digital signal converted from an analog signal, wherein the digital signal is provided to the first register.

7. The light emission driving device according to claim 6 arranged so that an output gain of the integration circuit is converted according to the light sources.

8. An illumination device comprising:

light sources;

a photo detector to provide an electrical signal, wherein an output signal is converted from sequentially on a time division basis illuminated light emitted from the light sources; and a light emission driving device according to claim 1, wherein an electrical signal from the photo detector is provided to the light emission driving device, and the light emission driving device drives the plurality of light sources sequentially on a time division basis.

9. The illumination device according to claim 8, wherein the light sources emit different colors from one another.

10. The illumination device according to claim 9, wherein each of the light sources is a light emitting diode.

11. The illumination device according to claim 9, wherein each of the light sources is an organic electroluminescence elemental device.

12. A display device comprising:

a liquid crystal display panel; and the illumination device according to claim 8, wherein the illumination device is arranged to illuminate the liquid crystal display panel.

13. The display device according to claim 12, wherein the liquid crystal display panel is driven by a field sequential driving method.

14. The display device according to claim 12, wherein the illumination device is driven by a pseudo impulse driving method having at least one light OFF period in one frame period.

15. A light emission driving device to drive multiple light sources comprising: a first storing part to store a detected light emission amount occurring during a previous illumination for one of the light sources, a second storing part to store predetermined value for comparison to the detected light emission amount, a third storing part to store a light emission amount control parameter set for the previous illumination of the same light source, and an operation circuit to calculate an output to control the same light source according to outputs from the first, second and third storing parts.

16. The light emission driving device according to claim 15 arranged so that the output from the operation circuit is utilized to set a light emission amount of a next illumination for the same light source.

17. The light emission driving device according to claim 15 arranged so that the output to control the same light source is calculated based on the first value by utilizing outputs from the first storing part and the second storing part.

18. The light emission driving device according to claim 17 arranged so that the calculation is based on the multiplication between the first value and the light emission amount control parameter set for the previous illumination of the same light source.

19. The light emission driving device according to claim 17 arranges to that the calculation is based on division of the first value and the light emission amount control parameter set for the previous illumination of the same light source.

* * * * *